United States Patent [19]

Vissers et al.

[11] 3,958,623

[45] May 25, 1976

[54] COOLER-DRIER FOR CASTINGS AND MOULDING SAND

[75] Inventors: Bastiaan Vissers, Heemstede; Willem Teunissen, Amstelveen, both of Netherlands

[73] Assignee: Expert N.V., Willemstad, Netherlands

[22] Filed: June 28, 1974

[21] Appl. No.: 484,103

[30] Foreign Application Priority Data

July 16, 1973 Netherlands ..... 7309900

[52] U.S. Cl. ..... 164/412; 164/4; 164/5; 164/154

[51] Int. Cl.[2] ..... B22C 5/08

[58] Field of Search ..... 164/4, 5, 154, 412

[56] References Cited

UNITED STATES PATENTS

| | | | |
|---|---|---|---|
| 2,277,953 | 3/1942 | Christensen | 164/4 X |
| 3,358,380 | 12/1967 | Murphy | 164/5 X |
| 3,388,478 | 6/1968 | Vissers | 164/131 X |

*Primary Examiner*—Ronald J. Shore
*Assistant Examiner*—Gus T. Hampilos
*Attorney, Agent, or Firm*—Snyder, Brown & Ramik

[57] ABSTRACT

Apparatus is disclosed which functions to adjust the moisture content of casting sand as it is being recovered, so that the sand may be re-used without significant or further adjustment of its water content. The apparatus includes a cooler-drier which receives hot castings and sand and discharges the sand and castings separately. A water spray impinges upon the sand and castings as they are moved through the cooler-drier and a temperature sensor which senses the temperature of the sand/castings mixture at the inlet controls the water spray so that the discharged sand possesses a uniform and selected moisture content.

3 Claims, 2 Drawing Figures

COOLER-DRIER FOR CASTINGS AND MOULDING SAND

The invention relates to a cooler-drier for castings and moulding sand comprising at least one water supply and a conveyor having a feeding end and a delivery end.

Such a cooler-drier is known.

In order to permit renewed use of the moulding sand emerging from the cooler-drier, the clay film around the quartz grains has to be maintained. For this purpose a sufficient degree of humidity of the moulding sand has to be permanently maintained. In order to permit a ready and automatic use of the moulding sand from the cooler-drier for the next casting process, the moulding sand emerging from the cooler-drier preferably has the degree of humidity most suitable for the next casting process in order to minimize drying or wetting of the moulding sand after emergence from the cooler-drier.

In the known cooler-drier the moulding sand emerges at the delivery end with an irregular degree of humidity, since the quantity of water evaporated during the cooling-drying process depends upon the varying heat content of the castings and moulding sand supplied to the cooler-drier.

The invention provides an improvement of the cooler-drier in this respect, which is characterized by at least one temperature pick-up arranged near the feeding end and by a control-member affected by said temperature pick-up and regulating the water supply. The heat content can be measured only with difficulty by means of a temperature pick-up arranged in the cooler-drier, since it is likely to be damaged by passing castings. If the temperature pick-up is protected from damage by means of a screen, this temperature pick-up is likely to become insensitive also due to moulding sand baking to the inner side of the screen.

In a preferred cooler-drier in accordance with the invention these problems are also solved, since a tapping for a fraction of the moulding sand arranged near the supply end is provided with the temperature pick-up.

Figure 1:
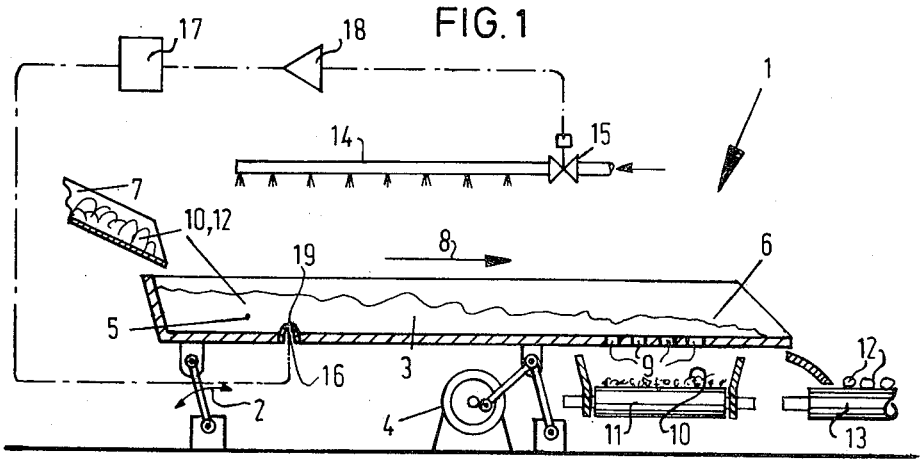
Figure 2:
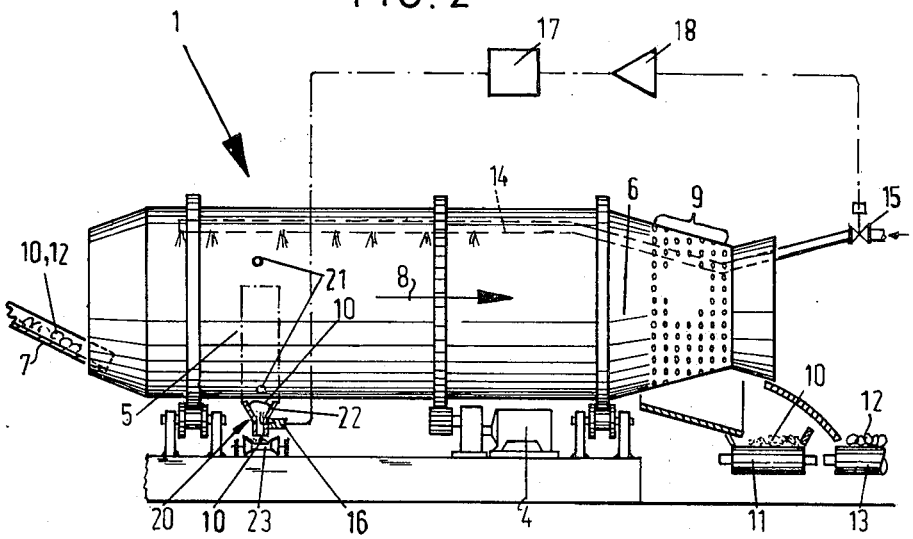

The invention will be described more fully hereinafter with reference to a drawing, which shows schematically:

in FIG. 1 a cooler-drier embodying the invention, and in FIG. 2 a preferred embodiment of the cooler-drier in accordance with the invention.

The cooler-drier 1 embodying the invention comprises a conveyor 3 having a feeding end 5 and a delivery end 6. As shown in FIG. 1, the conveyor 3 comprises a shaking gutter driven upwards and downwards by a driving gear 4 in the direction of the arrows 2 and as shown in FIG. 2 it comprises a drum rotated by a driving gear 4. The conveyor 3 conveys the castings 12 and the moulding sand 10, which are shed via a gutter 7 into the conveyor 3 in the direction of the arrow 8 from the feeding end 5 towards the delivery end 6, where the conveyor 3 comprises a sieve 9 for passing the moulding sand 10 to a conveyor belt 11 and where the castings 12 are delivered to a conveyor belt 13. The conveyor 3 comprises a water supply formed by a spraying tube 14 and controlled by a control-valve 15. Near the feeding end 5, that is to say at the place where the mould contents of castings 12 and moulding sand 10 have separated in the form of a liquid mass a temperature pick-up 16 is provided. This temperature pick-up 16 may be formed by a thermo-couple. The temperature pick-up 16 is coupled through a comparator 17, in which the registered temperature is compared with an adjusted value, and through an amplifier 18 with the control-valve 15 so that the quantity of water flowing out of the spraying tube 14 is regulated in dependence upon the temperature of the moulding sand at the feeding end 5.

As shown in FIG. 1 the temperature pick-up 16 is mounted in an extension projecting into the mass of castings 12 and moulding sand 10 and fastened to the conveyor 3.

As shown in FIG. 2, the cooler-drier 1 comprises near the feeding end 5 a tapping 20 formed by one or more openings 21 in the drum wall and a collecting funnel 22 opening out on a conveyor belt 23, in which funnel the temperature pick-up 16 is mounted. The tapping 20 may have only one opening, the size of which is equal to one of the meshes of the sieve 9. The temperature pick-up 16 in the funnel 22 is out of the reach of castings 12 and is therefore not likely to be damaged so that it may readily be formed by a sensitive temperature measuring instrument.

What is claimed is:

1. A cooler-drier for castings and moulding sand comprising, in combination:

a cooler-drier having a horizontally elongate conveying path defining a casting and moulding sand inlet at one end of said path, a sand outlet adjacent the other end of said path and a casting outlet at said other end of the path;

means for feeding a mixture of hot castings and sand to said inlet;

water spray means for directing water onto the mixture as it travels along said path and including a control valve for controlling the quantity of water so directed; and control means for causing said sand as delivered to said sand outlet to possess a uniform moisture content, said control menas comprising a temperature sensor for sensing the temperature of said mixture at said inlet and a control device for regulating said control valve in dependence on the temperature so sensed.

2. A cooler-drier as defined in claim 1 including means for progressively sampling sand at said inlet, said temperature sensor being in contact with sand so sampled.

3. A cooler-drier as defined in claim 1 wherein said cooler-drier is in the form of a horizontally elongate drum and including means for rotating said drum, said drum having at least one sand sampling opening at said inlet and there being a sample-receiving device receiving sand periodically from said opening as the drum rotates, said temperature sensor being in contact with sand in said device.

* * * * *